United States Patent [19]

Bock

[11] 4,126,217

[45] Nov. 21, 1978

[54] GOLF BALL VENDING MACHINE

[76] Inventor: Oscar Bock, P.O. Box 551, Madison, Wis. 53701

[21] Appl. No.: 815,599

[22] Filed: Jul. 14, 1977

[51] Int. Cl.[2] ..... G07F 11/54

[52] U.S. Cl. ..... 194/93

[58] Field of Search ..... 194/57, 58, 93, 92; 221/266, 277, 205

[56] References Cited

U.S. PATENT DOCUMENTS 3,946,847 3/1976 Bock ..... 194/57

*Primary Examiner*—Stanley H. Tollberg
*Attorney, Agent, or Firm*—Harry C. Engstrom; Theodore J. Long; Nicholas J. Seay

[57] ABSTRACT

A coin-controlled, manually operably golf ball vending machine capable of dispensing a selected number of balls for each coin deposited in the machine. The vending machine includes a ball hopper, a ramp below the hopper defining a ball dispensing opening between them, and a gate rotatably mounted at the opening which extends partially thereacross in a closed position to cause the balls to bridge the opening. An actuating lever is pulled forward to dispense balls held in a rotatable ball receptacle, and is then returned to its initial position. This action of the lever also swings the gate into the mass of balls in the hopper to break up the bridging of balls, and release a number of balls down the ramp to fill the rotatable ball receptacle which extends across the bottom of the ramp. The coin receiving mechanism is adapted to be operated by the action of the lever, and is further adapted to restrain movement of the lever when no coin has been deposited or when an improper sized coin has been deposited in the coin receiver.

4 Claims, 10 Drawing Figures

GOLF BALL VENDING MACHINE

BACKGROUND OF THE INVENTION

This invention pertains generally to machines for dispensing articles from a hopper, and more particularly to coin operated golf ball vending machines.

The usual manner of dispensing golf balls for practice at golf courses and driving ranges is in individual buckets stationed at a counter in a pro shop or driving range office. Because the office is usually located some distance from the range, this system is an inconvenience to golfers who must walk back and forth to get refills, as well as necessitating having personnel on duty to handle the transactions.

A typical golf ball dispenser is shown in U.S. Pat. No. 2,712,336, wherein a plurality of ball tubes are individually filled with a predetermined number of balls, and each tube is separately released by deposit of a coin in a coin receiver. Other golf ball dispensers are shown in my previously issued U.S. Pat. No. 3,946,847, and in my copending application Ser. No. 726,006. These machines are adapted to be located in remote positions along the driving range where electricity is not available, and are able to be operated by coin deposit without electrical actuation. In particular, the coin receiving mechanisms of these dispensers must be adapted to reliably receive coins of the proper size and to be actuated by such coins, while rejecting coins which are too large or too small. Moreover, it is desirable that the coin receiving mechanism be resistant to being jammed by coins of the incorrect size, or by bent coins or slugs.

SUMMARY OF THE INVENTION

The improved golf ball vending machine of my invention is controlled by coins received from a user and is manually operated by the user to dispense a predetermined number of balls. My vending machine utilizes only mechanical systems and does not require electricity for actuation, and can thus be utilitized in remote locations around the driving range where electricity is not available. The coin receiver of my golf ball vending machine is capable of rejecting coins which are both oversized and undersized, and is resistant to jamming by slugs and coins of the wrong size.

The vending machine includes a ball hopper having a ramp extending below the hopper to define a ball dispensing opening between the ramp and the bottom of the hopper. A "bridge buster" gate is positioned at the opening to cause balls to bridge across the opening when it is in its closed position, and to break up the ball bridge as it is swung upwardly into the mass of balls to thereby release the balls down the ramp to a cylindrical ball receptacle extending across the bottom end of the ramp. The gate is moved into the mass of balls as a lever extending out of the machine is turned by the user. A double action gate may be utilized, which moves into the mass of balls both on the forward stroke and on the return stroke of the lever, to provide a double discharge of balls down the ramp where a larger discharge of balls is desired.

The coin receiving mechanism of my golf ball vending machine has a support plate and a coin receiving draw plate mounted together, each of which partially extends from the front of the machine. A coin of the proper size is fitted into a horizontally disposed coin opening in the draw plate and receives vertical support by the support plate. The draw plate is withdrawn into the vending machine with the coin therein by the action of the user pulling on the actuating lever. If a coin is too large, it cannot be inserted into the coin opening in the draw plate, whereas if the coin is too small, the undersized coin will be discharged through a reject opening in the support plate as the draw plate is withdrawn. A spring loaded latch is positioned to engage with the walls of the coin receiving opening when it is empty to prevent further withdrawal of the draw plate and thus restrain further movement of the lever. The position of the cylindrical ball receptacle is set so that balls cannot be gotten from the machine by tilting it when the lever is in its partially open position and held by the latch.

Further objects, features and advantages of my invention will be apparent from the following detailed description taken in conjunction with the accompanying drawings showing preferred embodiments of a golf ball vending machine exemplifying the principles of my invention.

DESCRIPTION OF THE PREFERRED EMBODIMENTS

Figure 1:
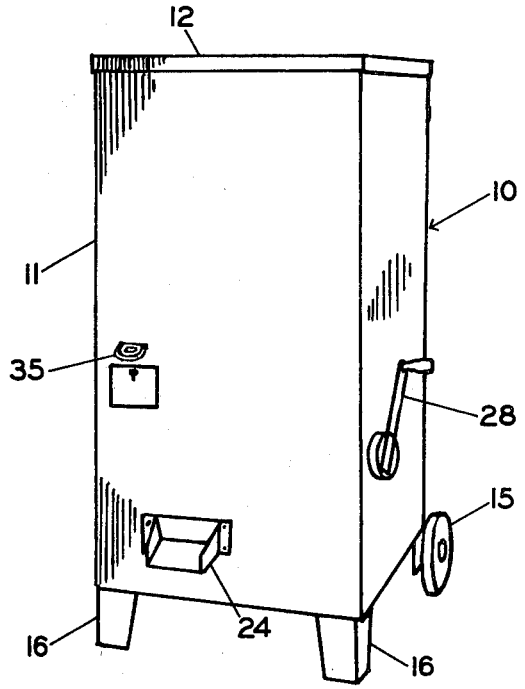
FIG. 1 is a prospective exterior view of the front and one side of a golf ball vending machine constructed in accordance with my invention.

Referring now more particularly to the drawings, wherein like numerals refer to like parts throughout the several views, a preferred embodiment of my golf ball vending machine is shown generally at 10 in FIG. 1. The vending machine has a cabinet 11 with a hinged top cover 12 for access to a ball hopper 13, best shown in FIGS. 2 and 3. A pair of interior side walls 14 form the sides of and provide support for the hopper. The vending machine 10 has a pair of rear wheels 15 at the back and a pair of rigid legs 16 mounted to the front corners.

Figure 4:
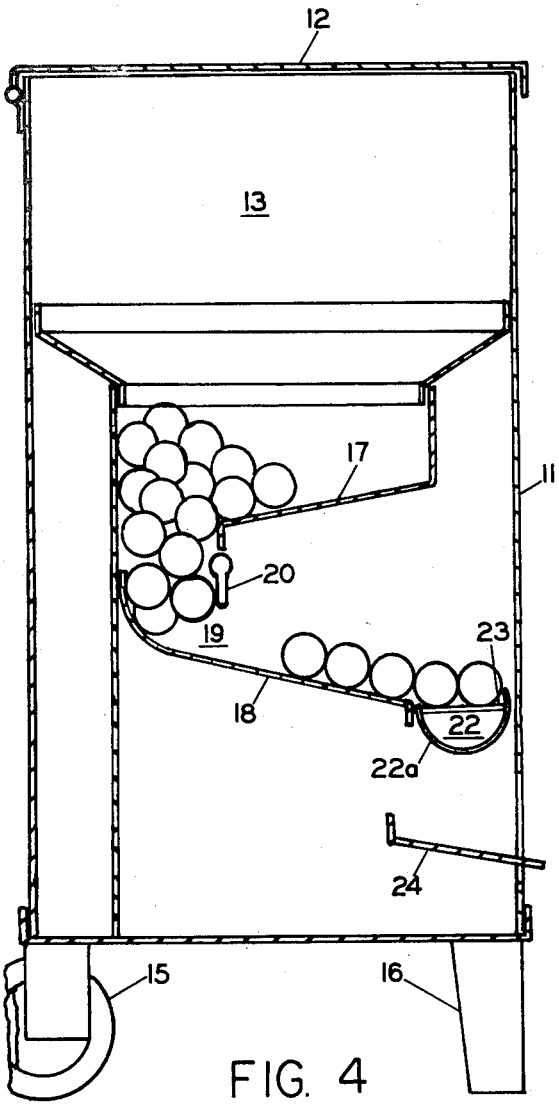
FIG. 4 is a schematic section view showing the ball path through the vending machine with the cylindrical ball receptacle in its ball receiving position.
Figure 5:
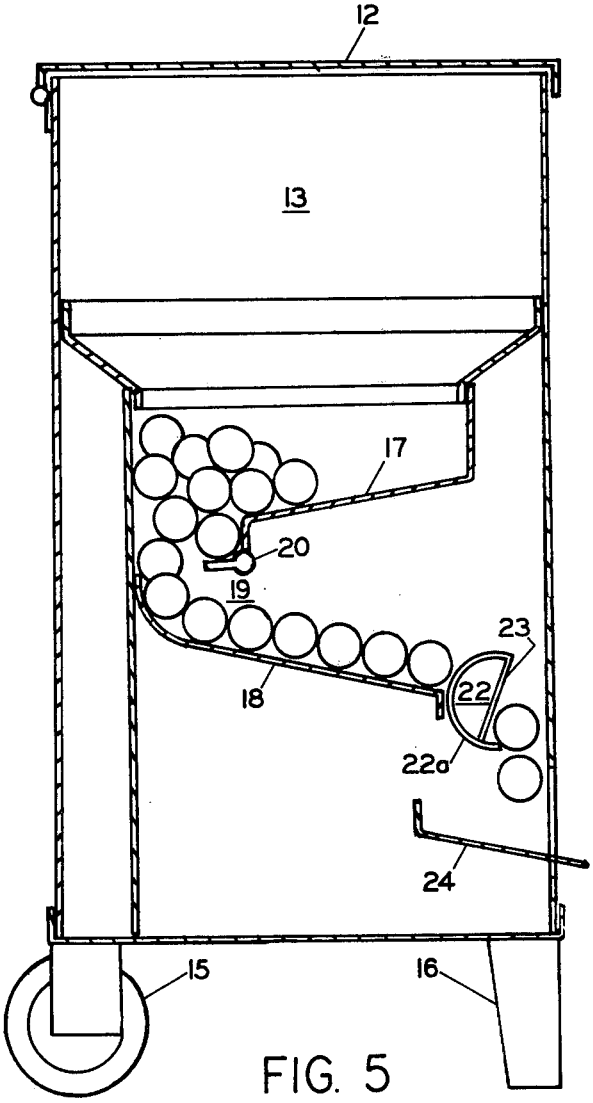
FIG. 5 is a schematic section view showing the ball path through the vending machine with the ball receptacle in its ball dumping position.
Figure 6:
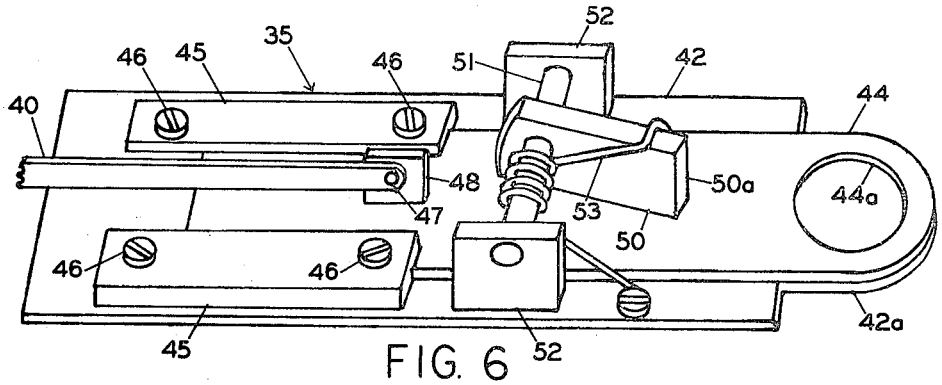
FIGS. 6–9 are prospective views of the coin receiver mechanism portion of my vending machine shown in sequential positions with and without a coin in the coin receiving opening.

As best shown in the cross sectional views of FIGS. 4 and 5, the ball hopper 13 has a tapered bottom and a rearwardly declining bottom pan 17. A forwardly declining ramp 18 extends below the pan 17 in spaced relation thereto so as to provide a ball dispensing opening 19 therebetween.

A discharge control gate 20 is rotably mounted across the ball dispensing opening 19. As shown in FIG. 4, when the gate 20 is in its closed position, it extends downwardly to a point more than the diameter of one golf ball but less than the diameter of two balls from the ramp 18, which results in balls bridging the opening and thus stopping the flow of balls between the gate 20 and the ramp 18. The gate 20 is to the side walls 14 and is rotatable about 90° from its downward position shown in FIG. 4 upwardly to its open position shown in FIG. 5. In rotating to the open position, it is driven or kicked into the mass of balls in the hopper to break up the bridged mass of balls and to allow the balls to move through the opening freely. The ramp 18 is preferably curved as shown to facilitate the slightly backward and upward movement of the balls along the curvature as the gate is swung rearwardly and upwardly to its open position.

Golf balls released through the opening 19 roll down the ramp 18 into a rotatably journaled ball receptacle 22 which extends across the lower end of the ramp. The ball receptacle 22 is semi-cylindrical between its ends, having an interior opening 23 formed therein for receiving balls passing from the ramp. The ball receptacle is adapted to hold the desired number of balls such as one layer deep of two rows of balls extending across the length of the ball receiving opening 23.

Figure 3:
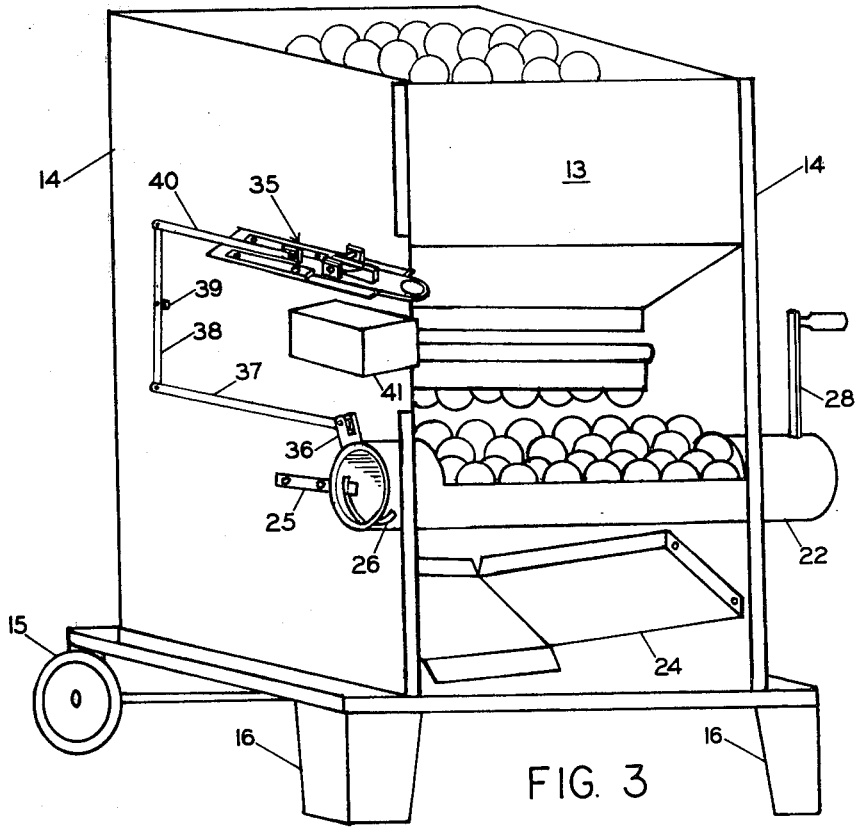
FIG. 3 is a prospective view of the vending machine with the exterior cabinet removed to show the working mechanisms on the side of the vending machine opposite to that shown in FIG. 2.

The curved rear surface **22*a* of the golf ball receptacle 22 rotates across the lower end of the ramp 18 to hold the balls on the ramp as the ball receptacle is rotated forwardly approximately 105° to its dumping position shown in FIG. 5. In this position, the balls are discharged onto a delivery pan 24 for exit from the vending machine. As best shown in FIG. 3, the rotation of the cylindrical ball receptacle 22 is limited by a lug 25, which is received in a keeper slot 26 formed in the periphery of the receptacle 22 at one end thereof. Engagement of the lug 25** with the walls of the keeper slot also prevents lateral movement of the ball receptacle.

Figure 2:
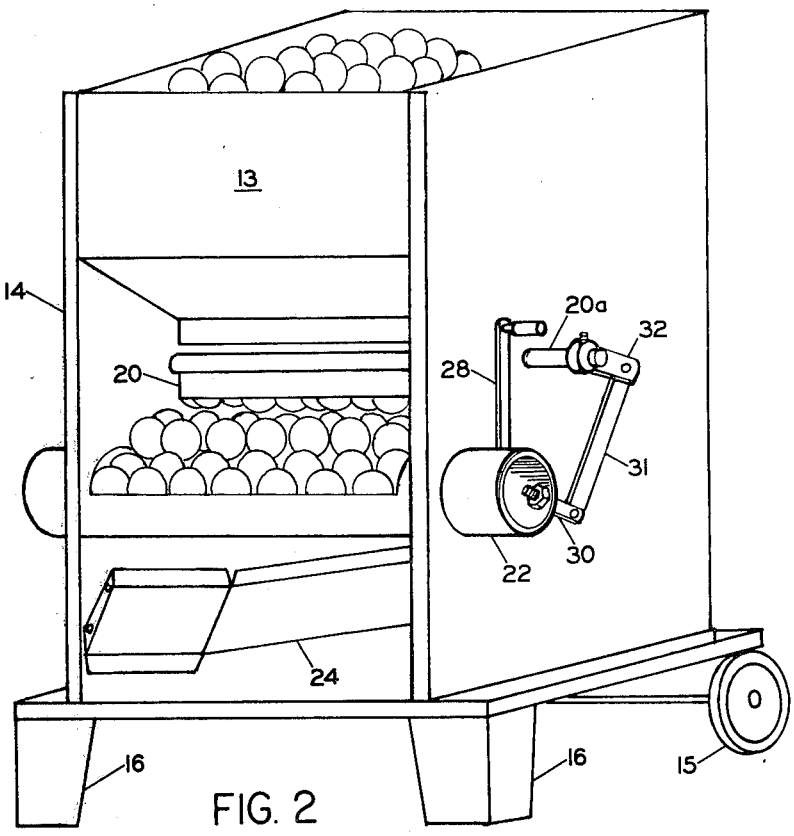
FIG. 2 is a prospective view of the vending machine with the exterior cabinet removed to show the working mechanisms on one side of the machine.

As best shown in FIG. 2, the vending machine is operated by a manually moved actuating lever 28 which is affixedly attached to and extends radially outwardly from one end of the ball receptacle 22. The ball receptacle is connected by a mechanical linkage to a protruding bar portion **20*a* of the gate 20. The linkage includes a first arm portion 30 fixedly attached and extending radially from the ball receptacle cylinder, a longer second arm 31 pivotally attached at one end to the arm 30, and a third short arm 32 pivotally attached at one end to the arm 31 and fixedly attached at the other end to the protruding journal bar 20*a*. Rotation of the actuating lever forwardly and then back again will cause the linkage to rotate the gate 20 upwardly into the balls on the forward stroke of the actuating lever, and again on the rearward or return stroke of the actuating lever. This double movement of the gate 20 into the mass of balls is preferred, since it provides a larger number of balls to the receptacle 22 on each stroke of the actuating lever 28**.

The coin releasable locking mechanism portion of my vending machine is shown generally at 35 in FIG. 3. A linkage connects the coin receiver to the rotatable ball receptacle 22. This linkage consists of a first stub 36 affixed to and extending outwardly from the periphery of the cylinder 22, a first straight link 37 which is pivotally connected at one end to the stub 36 and pivotally connected at the other end to a lever bar 38. The lever bar 38 is itself pivotally mounted at a pivot point 39 intermediate its ends to one of the interior side walls 14, and is pivotally attached at its other end to a second straight link 40. The straight link 40 is connected to and operates the coin mechanism 35, as will be discussed more fully below. It is apparent that forward rotation of the receptacle 22 will result in the second straight link 40 being drawn backwardly, while rotation of the receptacle backwardly will result in the link 40 being pushed forwardly. When the receptacle 22 is rotated to its discharge position, a coin deposited in the coin mechanism 35 will be discharged into a coin box 41.

The detailed construction and sequence of operation of the coin mechanism 35 is best shown in the views of FIGS. 6–9. The coin receiver 35 includes a bottom support plate 42 which has a portion **42*a* thereof which extends outwardly from the cabinet 11 of the vending machine. A coin receiving draw plate 44 rests flat upon the support plate 42 for sliding back and forth movement thereon. The draw plate 44 includes a coin receiving opening 44*a* therein located such that the coin opening will extend outwardly from the front of the vending machine in its forward position, wherein the extending portion 42*a* of the support plate will be underneath the opening 44*a*. The size of the opening 44*a*** is determined by the size of the desired coin which is to be received by the machine.

The draw plate 44 is firmly held for sliding back and forth movement on the support plate by a pair of notched guides 45, which are attached by screws 46 to the support plate and extend over the draw plate 44 to slidingly restrain the same. The second straight linkage 40 is pivotally connected at a pin 47 to a lug 48 which is affixed to and extends upwardly from the draw plate 44. It is apparent that back and forth motions of the straight link 40 will cause the draw plate 44 to be moved inwardly and outwardly.

As shown in each of the views of FIGS. 6–9, a latch bar 50 is rotatably mounted by a pin 51 to studs 52, which are themselves fixedly mounted to the top of the support plate 42. The latch 50 is resiliently biased downwardly against the draw plate 44 by a spring 53. The latch 50 has a front abutment face **50*a* which is adapted to engage with the walls defining the coin receiving opening 44*a*** in the draw plate.

Figure 7:
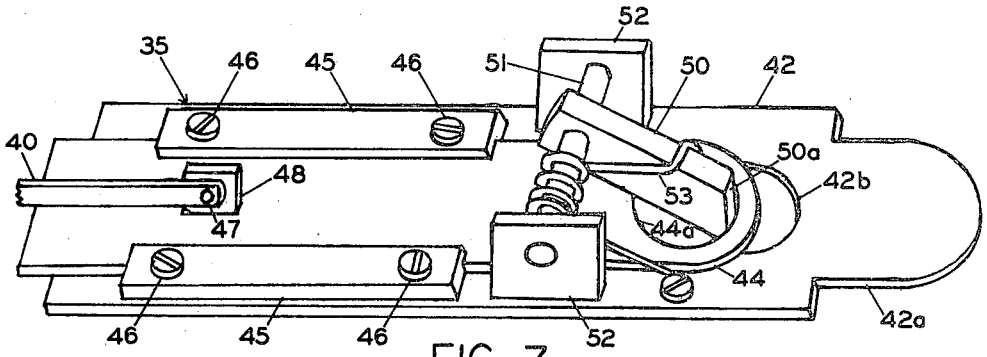

As best shown in the view of FIG. 7, if no coin has been deposited in the coin receiving opening **44*a*, movement backwards of the slide plate 44, as drawn by the link 40, will be restrained as the latch 50 moves into the coin receiving opening 44*a* and abuts against the far edge of the receiving opening. With reference to FIG. 3, it is seen that restraint of further movement of the draw plate 44 and the link 40 will prevent additional forward rotation of the receptacle 32 because of the restraint provided through the linkages 37, 38 and 40. The latch 50 is preferably positioned such that the movement of the draw plate 44 required before the latch 50 will engage the walls of the coin receiving opening is not great enough to allow the receptacle 22 to rotate far enough forward to allow balls to be dropped from the receptacle. Because the front wall of the cabinet 11 is closely positioned to the cylindrical receptacle 22**, balls cannot be removed from the receptacle in this intermediate position even if the entire vending machine is tilted forward.

To insure that smaller coins are not accepted by the machine or interposed in position to jam the machine, a coin reject opening **42*b* is provided in the support plate 42 at a position within the cabinet 11 of the machine. This opening is slightly smaller than the coin receiving opening 44*a*, so that proper sized coins will slide unimpeded over this reject opening while smaller sized coins will tend to fall into the opening. To expedite rejection of undersized coins, it is preferred that the spring biased latch 50 be positioned such that it will be biased into the reject opening 42***b*. Thus, the spring biased action of the latch 50 will tend to push small sized coins down into the opening 42*b* even if the draw plate 44 is very rapidly withdrawn by the user. Of course, once the rejected coin has been passed through the opening 42*b*, the latch 50 will engage the walls of the coin receiving opening 44*a* to prevent further rotation of the ball receptacle.

Figure 8:
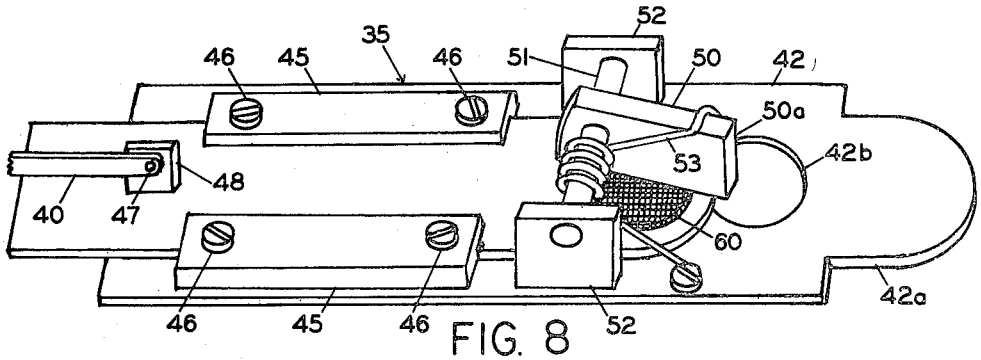
Figure 9:
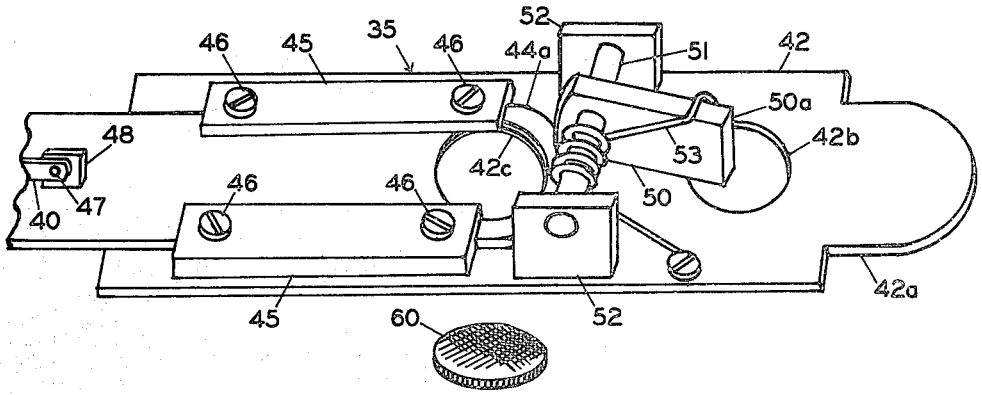

The action of my coin receiver where a proper sized coin has been inserted therein, is best shown in the views of FIGS. 8 and 9. In FIG. 8, a proper sized coin represented generally at 60 has been inserted into the coin receiving opening 44*a*, and the ball receptacle has been rotated forwardly far enough by the user to cause the draw plate to be withdrawn past the latch 50. Because the coin 60 is of the proper size, both in thickness and diameter, the latch 50 will ride over the coin and will not engage with the walls of the coin receiving opening 44*a*. Thus, it is preferred that the thickness of the draw plate 44 be approximately the same as that of the coin which is to be inserted within the coin receiving opening 44*a*. In the view of FIG. 9, the draw plate has been drawn back to its furthest position, corresponding to the full forward rotation of the receptacle 22 wherein the lug 25 engages with the ends of the slot 26 to prevent further forward movement of the receptacle. The coin receiving opening 44*a* in the draw plate is, at this point, precisely located above a coin discharge opening 42*c* in the support plate 42. The coin 60 drops by gravity through the discharge opening 42*c* and into the coin box 41. The discharge opening 42*c* is at least as large and is preferably somewhat larger than the coin receiving opening 44*a*, so that the coin may be discharged by gravity despite minor misalignments between the various parts of my machine.

It is further seen that as the user moves the handle 28 backwardly to rotate the receptacle 22 back into its ball receiving position, the draw plate 44 will be moved outwardly back to its position wherein the coin receiving opening is outside of the cabinet at the front of the vending machine. Further forward movement is prevented at this point by engagement of the lug 25 with the other end wall of the slot 26 in the receptacle 22.

Figure 10:
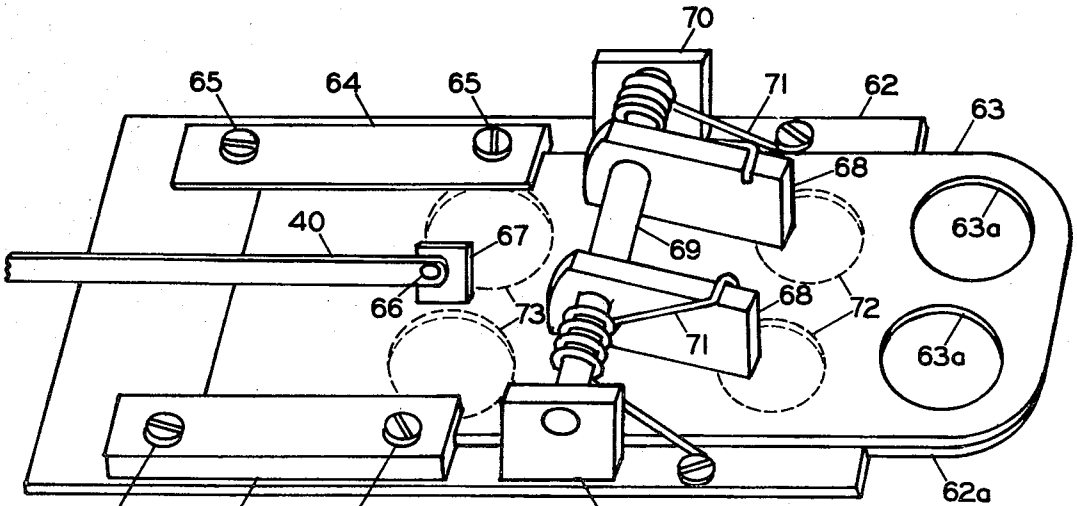
FIG. 10 is a prospective view of an alternative embodiment of the coin receiving mechanism portion of my golf ball vending machine.

A modified embodiment of the coin releasable locking mechanism of my vending machine, shown in FIG. 10, is adapted to receive two coins rather than one. A support plate 62 has a portion 62*a* thereof that extends outwardly from the front of the machine. A coin receiving draw plate 63 is slidingly mounted to the top of the support plate 62, and is held for sliding movement to the support plate by guides 64 which are themselves attached to the support plate by screws 65. The link 40, in this embodiment, is pivotally attached at a pivot 66 to a lug 67 which is firmly mounted to the top of the draw plate 63.

A pair of coin receiving openings 63*a* are formed in the end of the draw plate 63 in position to extend outwardly from the front of the vending machine, such that coins placed within the openings 63*a* will be supported by the extending portion 62*a* of the support plate 62. A pair of latch bars 68 are rotatably mounted to a pin 69, which is itself mounted to lugs 70 attached to the support plate 62. The latches 68 are biased downwardly against the draw plate by springs 71. The latches 68 are positioned to engage the walls of the coin receiving openings 63*a* as the draw plate is withdrawn by the link 40.

The operation of the coin receiver mechanism shown in FIG. 10 is entirely analogous to my coin receiver 35 described above, in that the latches 68 will engage with the walls of the coin receiving opening 63*a* if a coin of the proper size has not been inserted in both of the coin receiving openings. If undersized coins have been inserted in one or both of these openings, they will be discharged through a pair of reject openings in the support plate shown in dashed lines at 72 for illustrative purposes. These reject openings are preferably positioned underneath the ends of the latches 68. Full withdrawal of the draw plate 63 will cause proper sized coins inserted in the opening 63*a* to be discharged through discharge openings in the support plate 62 shown in dashed lines at 73 for illustration, and thence into the coin box.

It is understood that my invention is not confined to the particular construction and arrangement of parts herein illustrated and described, but embraces all such modified forms thereof as come within the scope of the following claims.

I claim:

1. A golf ball vending machine comprising:

(a) a ball hopper having a bottom pan;

(b) a declining ramp extending below said hopper bottom pan in spaced relation thereto, said pan and ramp defining a ball dispensing opening therebetween;

(c) a gate pivotally mounted below said hopper pan above said declining ramp at said opening rotatable between (1) a downwardly extending closed position wherein the lower edge of said gate is spaced more than the diameter of one ball and less than the diameter of two balls from said ramp to cause said balls in said hopper to bridge across said opening, and (2) a release position in which said gate is swung toward the mass of balls in the hopper to break up the bridging of balls therein for releasing balls down said ramp;

(d) a ball receptacle extending across the lower end of said declining ramp, said ball receptacle having an interior opening for receiving and holding balls therein and being rotatable between a ball receiving position wherein said interior opening is in position to receive balls from said ramp and a dumping position wherein the ball receptacle is rotated so that balls in said interior opening are discharged from said ball receptacle;

(e) manually movable actuating means operatively linked to said ball receptacle and said gate for (1) rotating said ball receptacle between its receiving position and its dumping position and for (2) rotating said gate at least once from said closed position to said release position and back to said closed position during the operation of said actuating means by an operator;

(f) a coin releasable locking mechanism for preventing operation of said manually movable actuating means, said locking mechanism having (1) a support plate having a portion thereof extending outwardly from the vending machine, (2) a draw plate mounted for sliding back-and-forth movement on said support plate between a foward coin-receiving position, an intermediate locking position, and a rear coin discharging position, (3) said draw plate having a coin receiving opening extending therethrough, said coin receiving opening being disposed over the extending portion of said support plate when said draw plate is in its forward coin receiving position so that a coin deposited in said coin receiving opening is supported therein by the extending portion of said support plate, (4) said support plate having a coin reject opening rearwardly of its extending portion, said coin reject opening being of smaller diameter than and positioned for alignment with the coin receiving opening in said draw plate when said draw plate is in its locking position for receiving any coin of smaller than proper size deposited in said coin receiving opening and allowing such smaller coin to be rejected through said reject opening but allowing said support plate to support a coin of proper size in said coin receiving opening, (5) latch means biased downwardly against the top of said draw plate for dropping into the coin receiving opening thereof when said draw plate is moved into its locking position to prevent further rearward movement for said draw plate when there is no coin of the proper size in said coin receiving opening, said latch means being adapted to ride over a properly sized coin in the coin receiving opening of said draw plate without dropping into the coin receiving opening and thereby allowing said draw plate to pass unimpeded through its intermediate locking position rearwardly to its coin-discharging position, (6) said support plate having a coin discharge opening rearwardly of said coin reject opening and positioned for alignment with the coin receiving opening in said draw plate when said draw plate is moved to its coin dropping position, said coin discharge opening being at least as large as said coin receiving opening for allowing coins to drop therethrough, and (g) mechanical linkage means linking said manually movable actuating means and said draw plate for drawing said draw plate rearwardly from its coin-receiving position, through its locking position to its rearward coin-discharging position, and back to its coin-receiving position, as the ball receptacle is rotated from its ball receiving position to its ball discharge position and back again, by operation of said actuating means when a coin of proper size has been deposited in the coin receiving opening in said draw plate.

2. The golf ball vending machine of claim 1 wherein said linkage means includes a first stub affixed to and extending outwardly from said ball receptacle, a first straight link pivotally connected at one end of said stub, a lever bar connected at one end to said first straight link and pivotally mounted at a point intermediate its ends, and a second straight link attached at one end to the other end of said lever bar, said second link being pivotally mounted at its other end to said draw plate.

3. The golf ball vending machine of claim 1 wherein said latch means includes a latch bar pivotally mounted to said support plate above said support plate, said latch bar having a front abutment face adapted to be engaged in the coin receiving opening in the draw plate, and a spring resiliently biasing said latch bar downwardly onto said draw plate and into said coin receiving opening.

4. The golf ball vending machine of claim 1 wherein said draw plate has at least two coin receiving openings therein, said support plate has at least two coin rejection openings therein smaller than and adapted to align with said coin receiving openings when said draw plate is in its locking position, said support plate also having at least one coin discharge opening at least as large as and adapted to align with said coin receiving openings when said draw plate is in its coin dropping position, and including latch means for dropping into each of said coin receiving openings when coins of the proper size are not contained within each of said coin receiving openings to restrain further rearward movement of said draw plate and prevent dumping of said ball receptacle.

* * * * *